US007906727B2

(12) United States Patent
Bradley

(10) Patent No.: US 7,906,727 B2
(45) Date of Patent: Mar. 15, 2011

(54) UMBILICAL BULLET CONNECTOR

(75) Inventor: Ryan Bradley, Cypress, TX (US)

(73) Assignee: Oceaneering International, Inc., Houston, TX (US)

( * ) Notice: Subject to any disclaimer, the term of this patent is extended or adjusted under 35 U.S.C. 154(b) by 193 days.

(21) Appl. No.: 12/198,334

(22) Filed: Aug. 26, 2008

(65) Prior Publication Data

US 2010/0052309 A1 Mar. 4, 2010

(51) Int. Cl.
*H01R 11/00* (2006.01)

(52) U.S. Cl. ..... 174/70 S; 114/322

(58) Field of Classification Search ..... 439/455; 294/66.1; 174/74 R, 79, 151, 652, 659, 70 S; 29/426.4; 114/322
See application file for complete search history.

(56) References Cited

U.S. PATENT DOCUMENTS

| | | | | | |
|---|---|---|---|---|---|
| 995,238 | A | * | 6/1911 | Evans | 439/455 |
| 1,523,371 | A | * | 1/1925 | Cadieux | 439/453 |
| 1,769,435 | A | * | 7/1930 | Kilkenny | 439/453 |
| 2,043,341 | A | * | 6/1936 | Turechek | 174/75 R |
| 2,686,828 | A | * | 8/1954 | Guy et al. | 174/663 |
| 2,756,402 | A | * | 7/1956 | Haworth et al. | 439/447 |
| 3,113,999 | A | * | 12/1963 | Heikkinen | 174/151 |
| 3,987,741 | A | * | 10/1976 | Tryon | 114/322 |
| 4,086,776 | A | * | 5/1978 | Beard | 405/185 |
| 4,189,620 | A | * | 2/1980 | Stange | 174/79 |
| 4,217,028 | A | * | 8/1980 | Reh et al. | 385/87 |
| 4,293,178 | A | * | 10/1981 | Lee | 439/462 |
| 4,733,935 | A | | 3/1988 | Gandy | |
| 5,115,485 | A | | 5/1992 | Gandy | |
| 5,159,651 | A | | 10/1992 | Gandy | |
| 5,183,966 | A | * | 2/1993 | Hurtado et al. | 174/20 |
| 5,195,219 | A | * | 3/1993 | Hurtig | 24/136 R |
| 5,403,976 | A | * | 4/1995 | Maurice | 174/652 |
| 6,028,974 | A | * | 2/2000 | Shyu et al. | 385/100 |
| 6,223,675 | B1 | | 5/2001 | Watt et al. | |
| 6,257,162 | B1 | | 7/2001 | Watt et al. | |
| 6,556,780 | B2 | | 4/2003 | Mjelstad et al. | |
| 6,584,253 | B2 | * | 6/2003 | Kordahi et al. | 385/100 |
| 6,943,300 | B2 | | 9/2005 | Ekeberg et al. | |
| 6,973,244 | B2 | | 12/2005 | Karlsen | |
| 7,047,616 | B2 | | 5/2006 | Bjerke et al. | |
| 7,158,703 | B2 | | 1/2007 | Mjelstad | |
| 7,241,075 | B2 | | 7/2007 | Ottesen et al. | |

FOREIGN PATENT DOCUMENTS

| | | |
|---|---|---|
| NO | 319664 | 9/2005 |

* cited by examiner

*Primary Examiner* — Neil Abrams
(74) *Attorney, Agent, or Firm* — Duane Morris LLP

(57) ABSTRACT

The invention described herein is directed to a bullet connector for umbilicals, and for a method of disconnecting an umbilical from a bullet connector. The bullet connector described herein comprises a tapered nose cone, a body comprising a cylindrical housing, a cylinder removeably mounted in the cylindrical housing, and a locking plate removeably fastened to the lower region of the cylinder. The invention described herein is further directed to a method for disconnecting a potted umbilical from an umbilical connector involving severing a potted umbilical above the tapered nose cone section of an umbilical connector comprising a locking plate, cylinder housing, and cylinder; disconnecting the locking plate of the umbilical connector from the cylinder of the umbilical connector; removing the cylinder of the umbilical connector from the cylinder housing of the umbilical housing of the umbilical connector; striking the portion of the umbilical extending from the upper face of the cylinder with sufficient force to knock its termination potting loose; and separating the umbilical from the cylinder.

18 Claims, 6 Drawing Sheets

UMBILICAL BULLET CONNECTOR

FIELD OF THE INVENTION

The invention described herein is directed to a bullet connector for umbilicals, and for a method of disconnecting an umbilical from a bullet connector. The bullet connector described herein comprises a tapered nose cone, a body comprising a cylindrical housing, a cylinder removeably mounted in the cylindrical housing, and a locking plate removeably fastened to the lower region of the cylinder.

BACKGROUND OF THE INVENTION

Umbilicals are long flexible cables, often is excess of 1000 feet in length. Umbilicals are often used to provide electrical power, hydraulic power, and/or fiber optic connections between a surface vessel and a subsea apparatus, such as a remotely operated vehicle (ROV) or other equipment located subsea.

DESCRIPTION OF THE PREFERRED EMBODIMENTS

Figure 1:
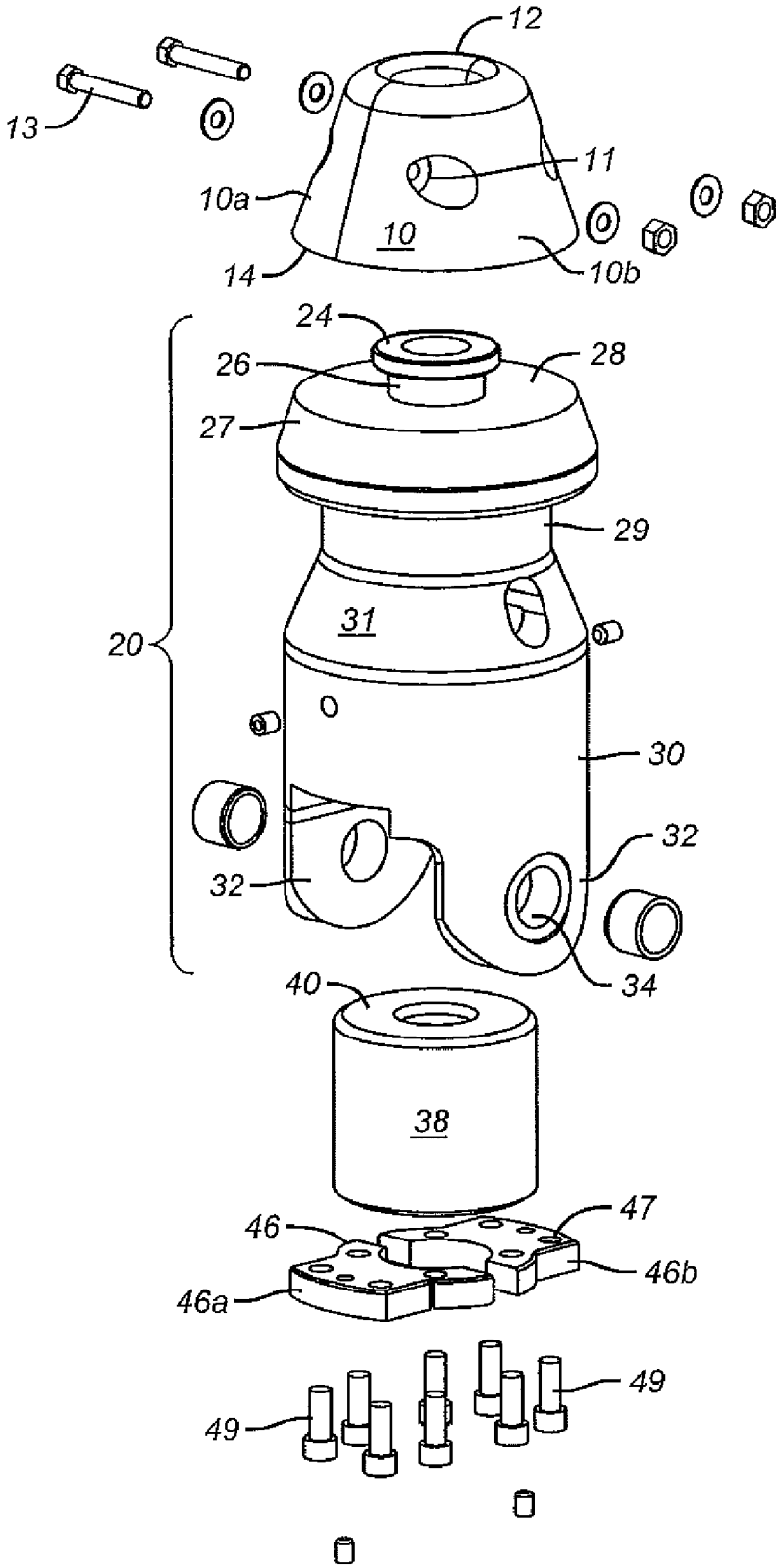
FIG. 1 is an exploded isometric view of one embodiment of the bullet connector described herein.
Figure 2:
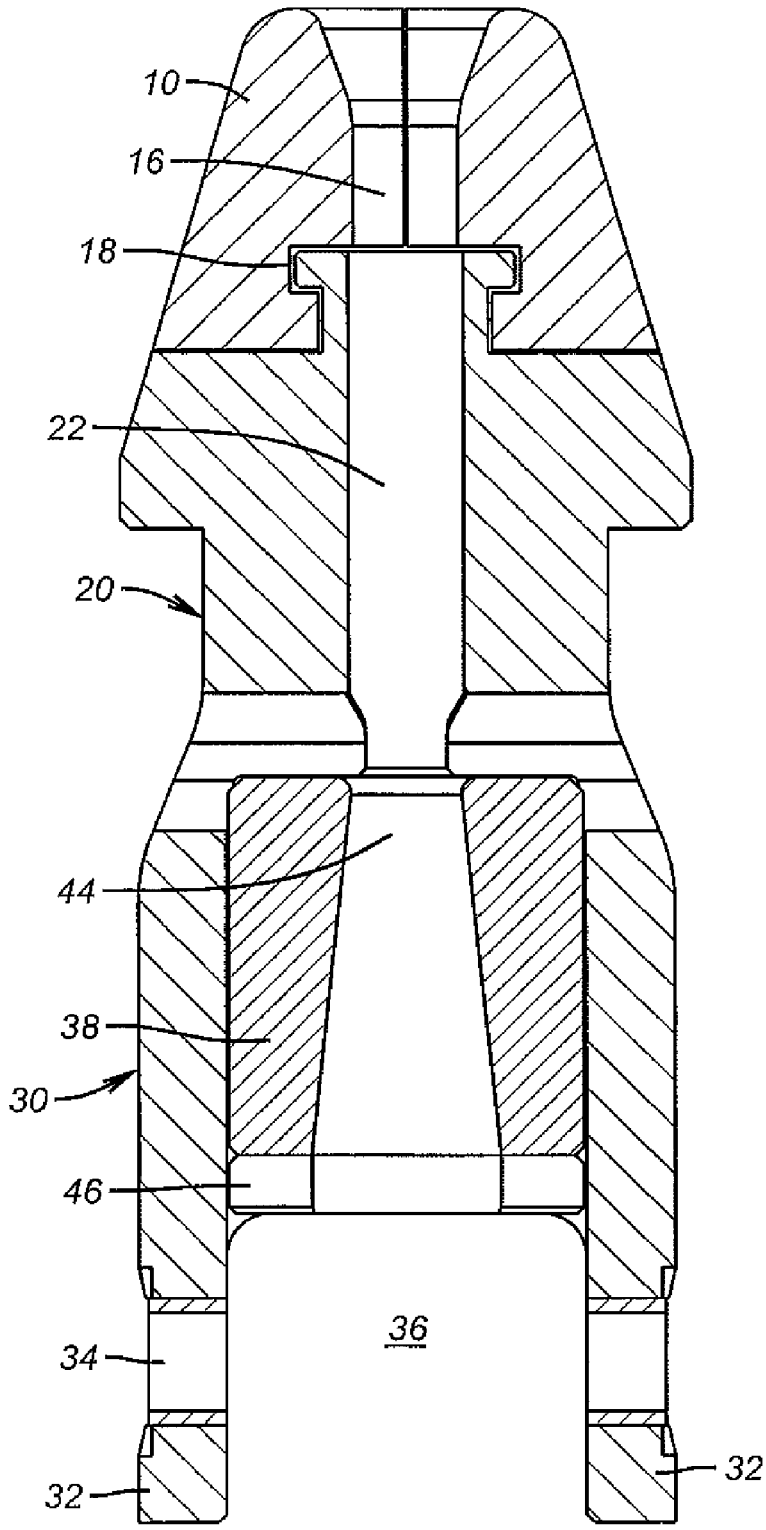
FIG. 2 is a side cross-sectional view of one embodiment of the bullet connector described herein.

Several preferred embodiments of the inventions described herein are directed toward an umbilical connector. A first preferred embodiment of an umbilical connector comprises a tapered nose cone 10 comprising a first tip 12 having a first diameter, a second tip 14 having a second diameter greater than the first diameter, an outer surface, and a first central longitudinal channel 16, as shown in FIGS. 1-2. The central longitudinal channel comprises an annular lip recess 18, as shown in FIGS. 1-2.

In another preferred embodiment, the nose cone comprises a first half 10*a* and a second half 10*b* opposite and secured to the first half, as shown in FIGS. 1-2. In another preferred embodiment, the first half and the second half comprise at least one transverse channel 11 extending from the outer surface of the first half to the outer surface of the second half, and a fastening member 13 mounted in the transverse channel.

This first preferred embodiment further comprises a body 20 comprising a second central longitudinal channel 22 aligned with the first longitudinal central channel, as shown in FIGS. 1-2. The body comprises a cylindrical lip 24 sized to fit in said lip recess, a throat region 26 attached to the lip and having an outer diameter that is less than the outer diameter of the lip, and a nose cone seating region 28 attached to the throat region and to the nose cone, as shown in FIGS. 1-2. The nose cone seating region has a first outer diameter, a first tapered region 27 extending radially outward and away from the nose cone seating region, a cylindrical first latch region 29 attached to the first tapered region and having a second outer diameter that is greater than the first outer diameter, and a lower region 30 attached to the first latch region.

The lower region comprises a tapered second latch region 31 extending radially outward and away from the first latch region and an outer wall, as shown in FIGS. 1-2. The outer wall comprises two fingers 32 extending therefrom and positioned on opposite sides of the wall, as shown in FIGS. 1-2. Each finger comprises an eyelet 34, as shown in FIG. 1. The fingers are sized and shaped to define a housing 36, as shown in FIG. 2. In a preferred embodiment, the housing is cylindrical. As shown in FIGS. 1-2, eyelets 34 and fingers 32 provide a pathway suitable for insertion of a pin may to connect the bullet connector to an ROV.

Figure 3:
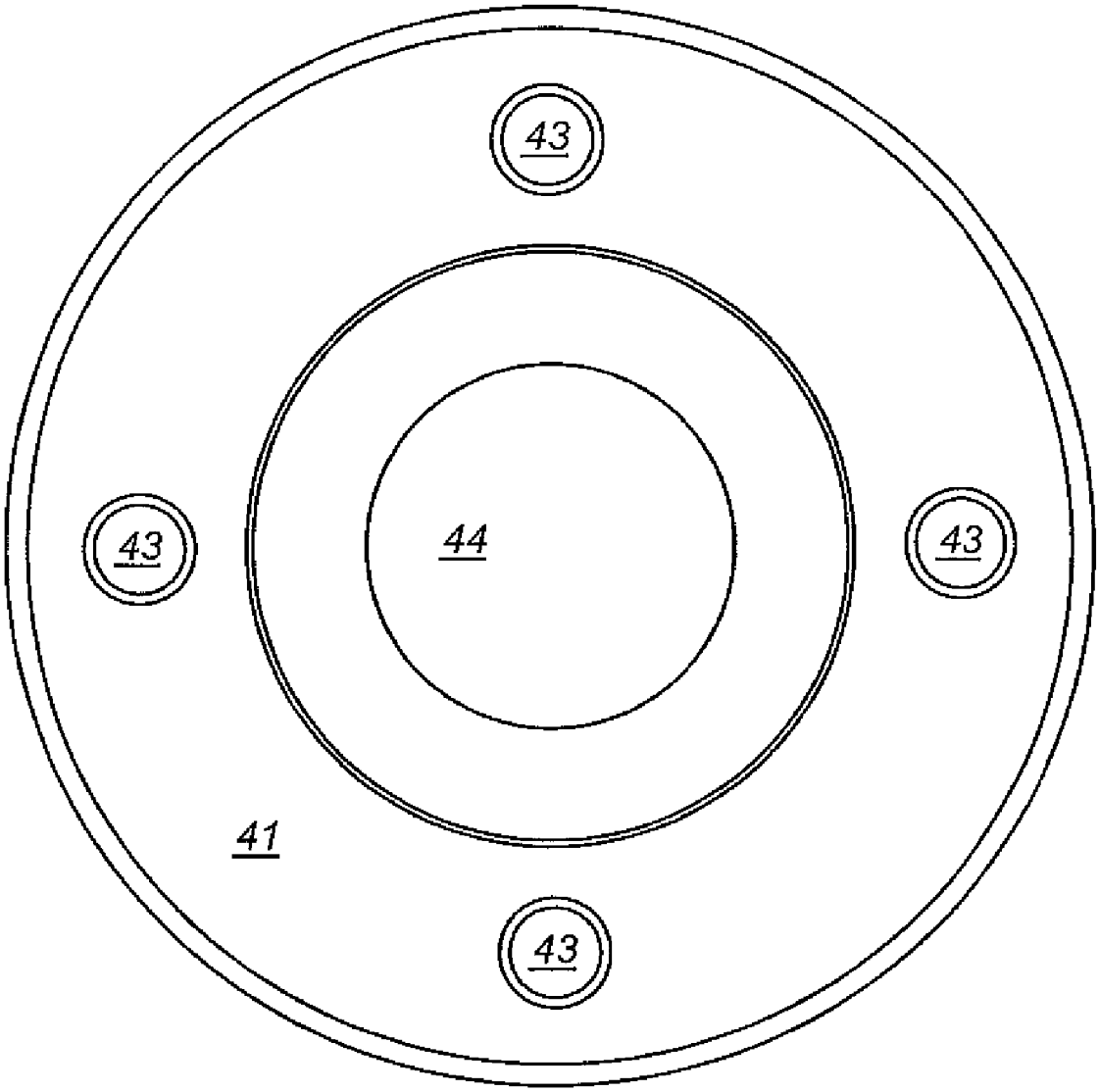
FIG. 3 is a bottom view of one embodiment of the termination member described herein.

This first preferred embodiment further comprises a termination member 38 removeably mounted in the housing, as shown in FIGS. 1-3. The termination member comprises an upper face 40, a lower face 41 opposite the upper face, and a third central longitudinal channel 44. In a preferred embodiment, the third central longitudinal channel comprises a conical region whose diameter increases as the distance from the upper face increases. In a preferred embodiment, the termination member is cylindrical.

This first preferred embodiment further comprises a locking plate 46 removeably fastened to the lower region below and in contact with the termination member, as shown in FIGS. 1-2. Locking plate 46 fastens termination member 38 to the body 30, thereby permitting removal of termination member 38 from the body.

Figure 6:
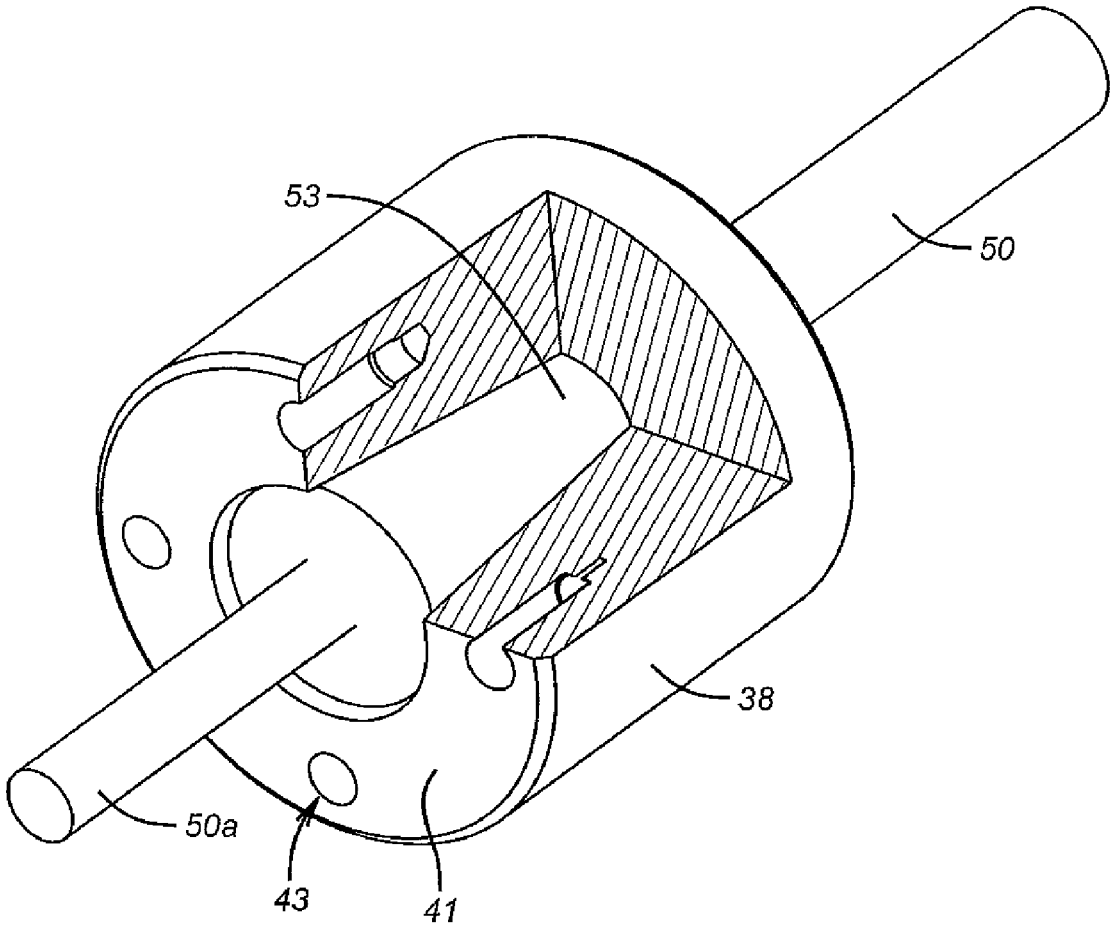
FIG. 6 is an isometric view of a termination potting.

As shown in FIG. 6, an enlargement 53 , which may be formed of potting, is provided on the umbilical 50.

In another preferred embodiment, the locking plate comprises at least one fastening member hole 47, and the lower face 41 of the termination member comprises at least one fastening member hole 43 aligned with the locking plate fastening member hole. In another preferred embodiment, the umbilical connector comprises a fastening member 49 extending through the locking plate fastening member hole and the termination member fastening member hole. In another preferred embodiment, the fastening member hole in the lower face of the termination member is threaded and the fastening member is a bolt.

In another preferred embodiment, the locking plate comprises a first half 46*a* and a second half 46*b* opposite to the first half, as shown in FIG. 1. In this embodiment, the lower face of the termination member comprises at least one fastening member hole aligned with each of the locking plate halves fastening member holes, as shown in FIG. 3. In another preferred embodiment, the connector further comprises a fastening member 49 extending through each locking plate half fastening member hole and each termination member fastening member hole, as shown in FIG. 1. In another preferred embodiment, each fastening member hole in the lower face of the termination member is threaded and each fastening member is a bolt.

Figure 5:
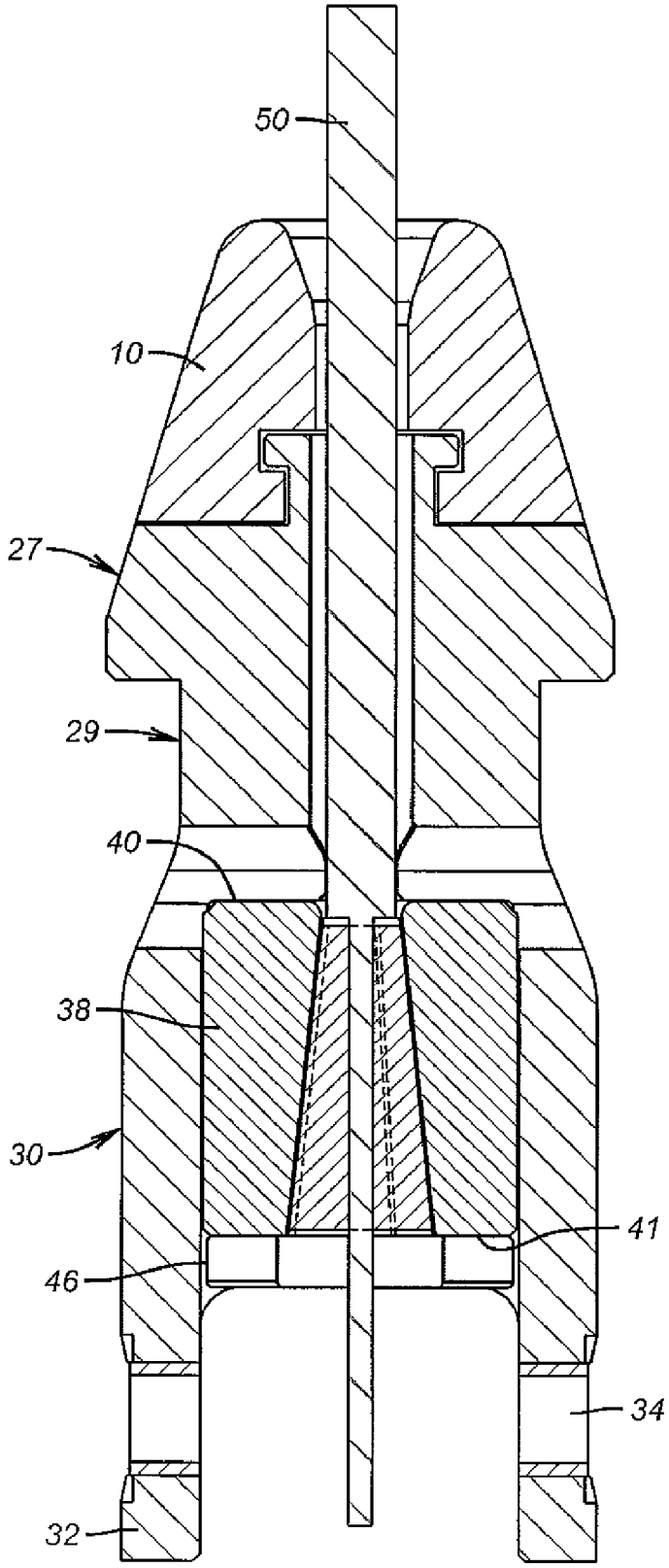
FIG. 5 is a side cross sectional view of a bullet connector as described herein attached to an umbilical.

In another preferred embodiment, the connector further comprises a universal joint pivotably connected to the lower region. In another preferred embodiment, the connector further comprises an umbilical 50 extending through the first, second and third central longitudinal channels, and sized to snugly fit in said channels, as shown in FIG. 5.

A second preferred embodiment of the inventions described herein is directed toward a method of disconnecting an umbilical from an umbilical connector. A preferred embodiment of this method comprises severing an umbilical above the tapered nose cone section of an umbilical connector comprising a locking plate, cylinder housing, and cylinder, as shown in Block 80 of FIG. 4.

Figure 4:
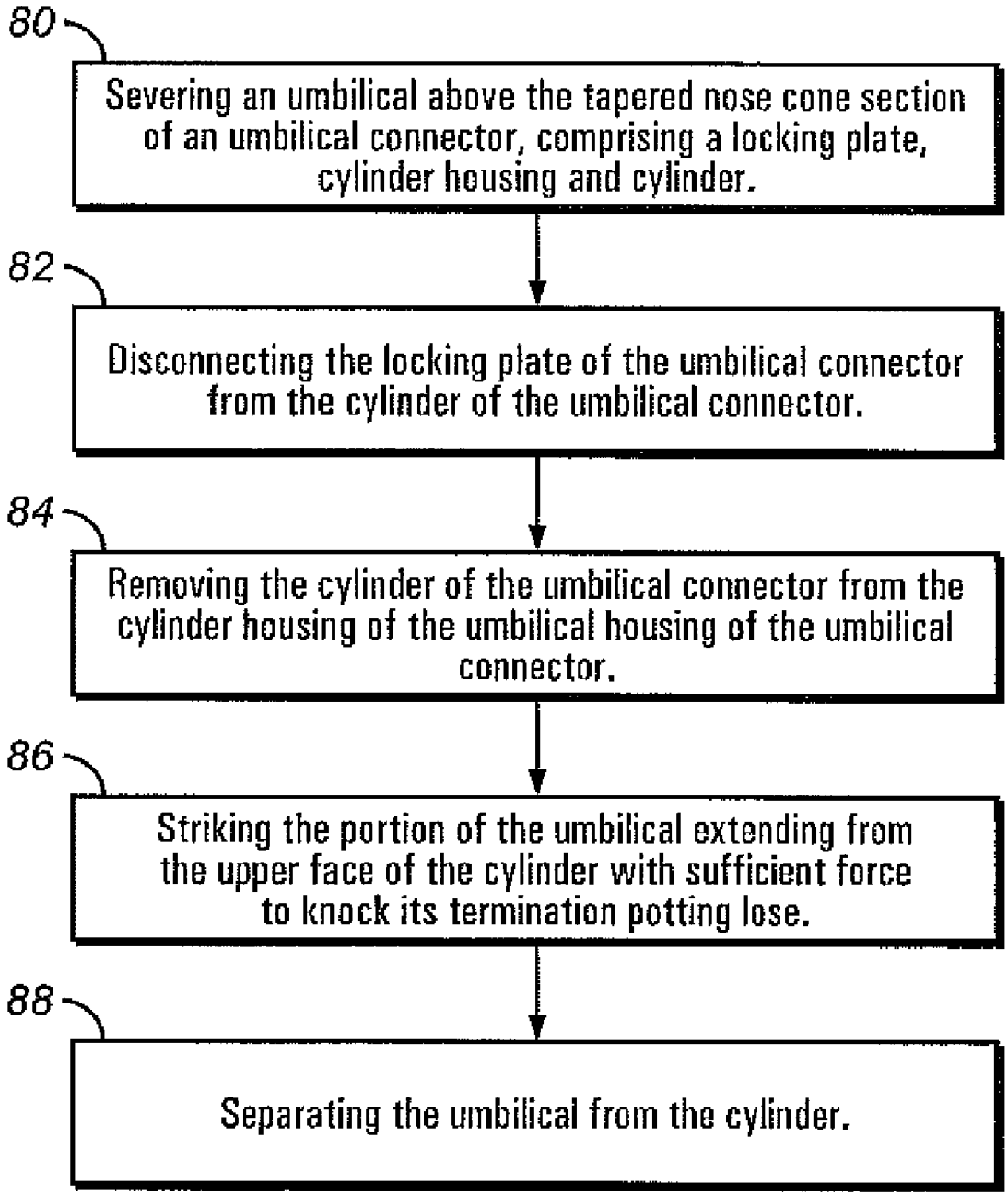
FIG. 4 is a block diagram of a method for using the bullet connector described herein.

This preferred method embodiment further comprises disconnecting the locking plate of the umbilical connector from the cylinder of the umbilical connector, as shown in Block 82 of FIG. 4.

This preferred method embodiment further comprises removing the cylinder of the umbilical connector from the cylinder housing of the umbilical housing of the umbilical connector, as shown in Block 84 of FIG. 4.

This preferred method embodiment further comprises striking the portion of the umbilical extending from the upper face of the cylinder with sufficient force to knock its termination potting loose, as shown in Block 86 of FIG. 4.

This preferred method embodiment further comprises separating the umbilical from the cylinder, as shown in Block 88 of FIG. 4.

The foregoing disclosure and description of the inventions are illustrative and explanatory. Various changes in the size, shape, and materials, as well as in the details of the illustrative construction and/or a illustrative method may be made without departing from the spirit of the invention.

What is claimed is:

1. An umbilical connector, comprising;

a. a tapered nose cone comprising a first tip having a first diameter, a second tip having a second diameter greater than the first diameter, an outer surface, and a first central longitudinal channel, said channel comprising an annular lip recess;

b. a body comprising a second central longitudinal channel aligned with the first longitudinal central channel:

i. a cylindrical lip sized to fit in said lip recess, ii. a throat region attached to the lip and having an outer diameter that is less than the outer diameter of the lip, iii. a nose cone seating region attached to the throat region and to the nose cone, said nose cone seating region having a first outer diameter, iv. a first tapered region extending radially outward and away from the nose cone seating region, v. a cylindrical first latch region attached to the first tapered region and having a second outer diameter that is greater than the first outer diameter, vi. a lower region attached to the first latch region, said lower region comprising, a tapered second latch region extending radially outward and away from the first latch region, an outer wall, said outer wall comprising two fingers extending therefrom and positioned on opposite sides of the wall, each finger comprising an eyelet, and said fingers being sized and shaped to define a housing;

c. a termination member removeably mounted in the housing and comprising an upper face, a lower face opposite the upper face, and a third central longitudinal channel; and d. a locking plate removeably fastened to the termination member below and in contact with the cylinder.

2. The umbilical connector of claim 1, wherein the nose cone comprises a first half and a second half opposite and secured to the first half.

3. The umbilical connector of claim 2, wherein the first half and the second half comprise:

a. at least one transverse channel extending from the outer surface of the first half to the outer surface of the second half; and b. a fastening member mounted in the transverse channel.

4. The umbilical connector of claim 1, wherein:

a. the locking plate comprises at least one fastening member hole; and b. the lower face of the termination member comprises at least one fastening member hole aligned with the locking plate fastening member hole.

5. The umbilical connector of claim 4, further comprising a fastening member extending through the locking plate fastening member hole and the termination member fastening member hole.

6. The umbilical connector of claim 1, wherein the locking plate comprises a first half and a second half opposite to the first half.

7. The umbilical connector of claim 1, wherein:

a. the first half and the second half of the locking plate each comprise at least one fastening member hole; and b. the lower face of the termination member comprises at least one fastening member hole aligned with each of the locking plate halves fastening member holes.

8. The umbilical connector of claim 7, further comprising a fastening member extending through each locking plate half fastening member hole and each termination member fastening member hole.

9. The umbilical connector of claim 1, wherein the third central longitudinal channel comprising a conical region whose diameter increases as the distance from the upper face increases.

10. The umbilical connector of claim 1, wherein the housing and the termination member are cylindrical.

11. A method for disconnecting art a potted umbilical from an umbilical connector comprising:

a. severing a potted umbilical above the tapered nose cone section of an umbilical connector comprising a locking plate, cylinder housing, and cylinder;

b. disconnecting the locking plate of the umbilical connector from the cylinder of the umbilical connector;

c. removing the cylinder of the umbilical connector from the cylinder housing of the umbilical housing of the umbilical connector;

d. striking the portion of the umbilical extending from the upper face of the cylinder with sufficient force to knock its termination potting loose; and e. separating the umbilical from the cylinder.

12. An umbilical connector, comprising;

a. a tapered nose cone comprising a first tip having a first diameter, a second tip having a second diameter greater than the first diameter, an outer surface, and a first central longitudinal channel, said channel comprising an annular lip recess;

b. a body comprising a second central longitudinal channel aligned with the first longitudinal central channel:

i. a cylindrical lip sized to fit in said lip recess, ii. a throat region attached to the lip and having an outer diameter that is less than the outer diameter of the lip, iii. a nose cone seating region attached to the throat region and to the nose cone, said nose cone seating region having a first outer diameter, iv. a first tapered region extending radially outward and away from the nose cone seating region, v. a cylindrical first latch region attached to the first tapered region and having a second outer diameter that is greater than the first outer diameter, vi. a lower region attached to the first latch region, said lower region comprising, a tapered second latch region extending radially outward and away from the first latch region, an outer wall, said outer wall comprising two fingers extending therefrom and positioned on opposite sides of the wall, each finger comprising an eyelet, and said fingers being sized and shaped to define a housing;

c. a termination member removeably mounted in the housing and comprising an upper face, a lower face opposite the upper face, and a third central longitudinal channel comprising a conical region whose diameter increases as the distance from the upper face increases; and d. a locking plate removeably fastened to the termination member below and in contact with the cylinder.

13. The umbilical connector of claim 12, wherein:

a. the locking plate comprises at least one fastening member hole; and b. the lower face of the termination member comprises at least one fastening member hole aligned with the locking plate fastening member hole.

14. The umbilical connector of claim 13, further comprising a fastening member extending through the locking plate fastening member hole and the termination member fastening member hole.

15. The umbilical connector of claim 12, wherein the locking plate comprises a first half and a second half opposite to the first half.

16. The umbilical connector of claim 12, wherein:

a. the first half and the second half of the locking plate each comprise at least one fastening member hole; and b. the lower face of the termination member comprises at least one fastening member hole aligned with each of the locking plate halves fastening member holes.

17. The umbilical connector of claim 12, wherein the nose cone comprises a first half and a second half opposite and secured to the first half.

18. The umbilical connector of claim 17, wherein the first half and the second half comprise:

a. at least one transverse channel extending from the outer surface of the first half to the outer surface of the second half; and b. a fastening member mounted in the transverse channel.

* * * * *